US011040225B2

(12) United States Patent
Contino et al.

(10) Patent No.: US 11,040,225 B2
(45) Date of Patent: Jun. 22, 2021

(54) BACK-UP CREW BREATHING GAS SYSTEM AND METHOD

(71) Applicant: AVOX Systems Inc., Lancaster, NY (US)

(72) Inventors: Joseph J. Contino, East Amherst, NY (US); Duard Bennett, Kenmore, NY (US)

(73) Assignee: AVOX Systems Inc., Lancaster, NY (US)

( * ) Notice: Subject to any disclaimer, the term of this patent is extended or adjusted under 35 U.S.C. 154(b) by 725 days.

(21) Appl. No.: 15/146,828

(22) Filed: May 4, 2016

(65) Prior Publication Data

US 2016/0325122 A1 Nov. 10, 2016

Related U.S. Application Data

(60) Provisional application No. 62/156,563, filed on May 4, 2015.

(51) Int. Cl.

| | |
|---|---|
| ***A62B 7/14*** | (2006.01) |
| ***A62B 7/02*** | (2006.01) |
| ***F17C 11/00*** | (2006.01) |
| ***A62B 18/02*** | (2006.01) |

(52) U.S. Cl.

CPC ..... *A62B 7/14* (2013.01); *A62B 7/02* (2013.01); *F17C 11/00* (2013.01); *A62B 18/02* (2013.01)

(58) Field of Classification Search

CPC .... A62B 7/02; A62B 7/14; A62B 9/00; A62B 9/02

See application file for complete search history.

(56) References Cited

U.S. PATENT DOCUMENTS

| | | | | |
|---|---|---|---|---|
| 4,651,728 | A * | 3/1987 | Gupta | A62B 7/14 128/201.28 |
| 5,199,423 | A * | 4/1993 | Harral | A62B 7/14 128/202.26 |
| 5,730,121 | A * | 3/1998 | Hawkins, Jr. | A62B 7/14 128/205.24 |
| 5,865,174 | A * | 2/1999 | Kloeppel | A61M 16/00 128/204.21 |
| 2003/0233936 | A1* | 12/2003 | Crome | A62B 7/14 95/96 |
| 2007/0144597 | A1* | 6/2007 | Cazenave | B64D 11/00 137/899.2 |

(Continued)

*Primary Examiner* — Valerie L Woodward

(74) *Attorney, Agent, or Firm* — Kilpatrick Townsend & Stockton LLP

(57) ABSTRACT

A system and a method for providing a secondary source of breathing gas to a mask are disclosed. The system includes secondary reservoir having a breathing gas, the secondary reservoir connected to a primary line by a secondary line. A pressure switch detects a pressure in the primary line and, upon a pressure lower than a threshold, actuates an actuator to permit the flow of breathing gas from the secondary reservoir through the secondary line. A valve may be configured to prevent a flow of gas from the secondary line to a source side of the primary line. The method includes detecting gas pressure and actuating an actuator upon a low gas pressure to permit a flow of secondary gas to the breathing mask by way of a secondary line. The gas may be prevented from flowing from the secondary line to a source side of the primary line.

11 Claims, 2 Drawing Sheets

(56) References Cited

U.S. PATENT DOCUMENTS

| | | | | |
|---|---|---|---|---|
| 2010/0012116 | A1* | 1/2010 | Rittner | A62B 7/08<br>128/202.26 |
| 2011/0000490 | A1* | 1/2011 | Gillotin | A62B 7/14<br>128/204.26 |
| 2015/0094202 | A1* | 4/2015 | Dolan | F17D 5/005<br>502/401 |
| 2016/0354620 | A1* | 12/2016 | Sharma | A62B 18/10 |

* cited by examiner

BACK-UP CREW BREATHING GAS SYSTEM AND METHOD

CROSS-REFERENCE TO RELATED APPLICATIONS

This application claims priority to U.S. Provisional Application No. 62/156,563, filed on May 4, 2015, the disclosure of which is incorporated herein by reference.

FIELD OF THE DISCLOSURE

The invention relates to breathing gas systems for aircraft, and more particularly to back-up sources of breathing gas.

BACKGROUND OF THE DISCLOSURE

Pressurized aircraft are provided with emergency oxygen systems (breathing gas systems) for use in the situation where cabin pressurization fails at an altitude which is above a safe level. Oxygen masks are disposed throughout the cabin of an aircraft and are pneumatically connected with oxygen source(s).

An emergency oxygen system is also provided in the cockpit for use by the flight crew. Masks are disposed in the cockpit for use by the crew, and are in pneumatic communication with at least one oxygen source. Typically, an emergency crew oxygen system is maintained at an operating pressure through the system to the masks by way of tubes connecting the masks to the oxygen source. When actuated, the emergency system quickly provides oxygen to the masks for use by the crew, while the crew works to bring the aircraft to a safe altitude for breathing without the need for supplemental oxygen. However, in the event of a failure in the crew emergency oxygen system, the crew may be without the use of supplemental oxygen during a critical time.

BRIEF SUMMARY OF THE DISCLOSURE

In an embodiment, a system for providing a secondary source of breathing gas to a mask is disclosed. The system includes secondary reservoir having a breathing gas at a supply pressure. A secondary line pneumatically connects the secondary reservoir to a primary line. An actuator is configured to permit the flow of breathing gas from the secondary reservoir through the secondary line upon actuation. A pressure switch is configured to sense a gas pressure in the primary line. The pressure switch actuates the actuator upon a loss of pressure in the primary line. A primary line check valve is configured to prevent a flow of gas from the secondary line to a source side of the primary line.

In another aspect, a method for providing a secondary source of breathing gas to a mask is disclosed. The method includes detecting gas pressure lower than a pre-determined threshold in a primary line using a pressure switch, the primary line being in pneumatic communication with a breathing mask. An actuator is actuated to permit a flow of secondary gas to the breathing mask by way of a secondary line. The actuator may be actuated by an electrical signal sent to the actuator. A pressure of the secondary gas is reduced to an operating pressure. The gas may be prevented from flowing from the secondary line to a source side of the primary line.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Figure 1:
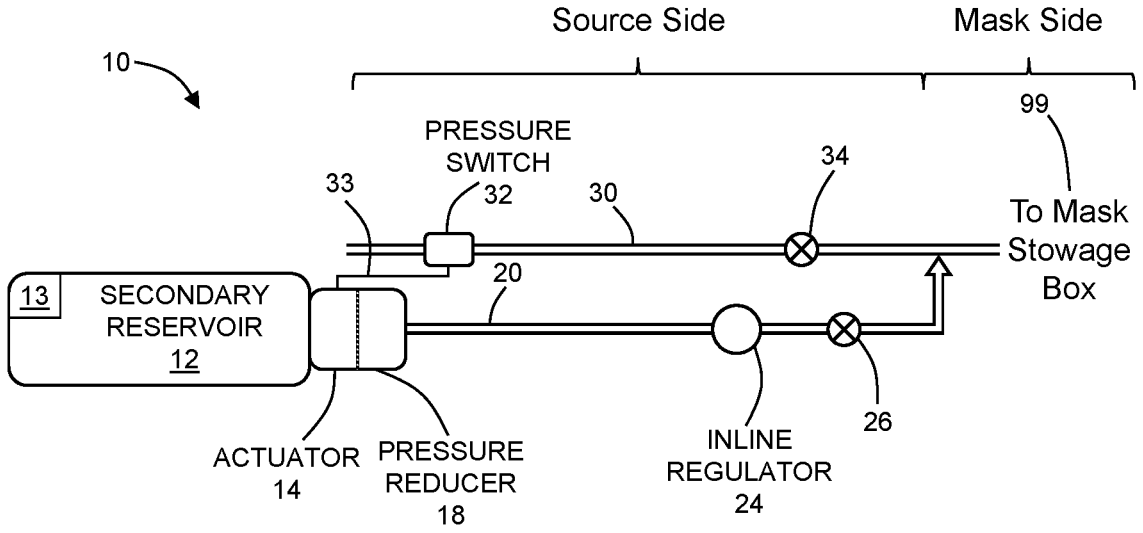
FIG. 1 is a diagram of a system according to an embodiment of the present disclosure in pneumatic communication with a primary line.

The present disclosure may be embodied as a system 10 for providing a secondary source of breathing gas to a mask 99 (see, for example, FIG. 1). The system 10 has a secondary reservoir 12 which contains a breathing gas. For example, the secondary reservoir 12 may contain oxygen. The secondary reservoir 12 stores the gas at a supply pressure. For example, the secondary reservoir 12 may store the breathing gas at a pressure higher than 500 psig, for example, 3,000 psig. The secondary reservoir 12 may store a quantity of gas sufficient for use by the crew in a particular application. The volume of gas held be the secondary reservoir 12 may be related to the pressure at which the gas is stored. For example, at 3,000 psig, the secondary reservoir 12 may hold 300 L of breathing gas. Such a volume and pressure may be sufficient as a secondary (back-up) source of breathing gas, for example, to two crew members, such as a captain and a first officer. The secondary reservoir 12 may include an indicator 13 to indicate the contents of the secondary reservoir 12, for example, indicating the pressure of the reservoir.

A secondary line 20 pneumatically connects the secondary reservoir 12 to a primary line 30. In some embodiments of the present disclosure, the primary line 30 does not make up a portion of the system 10, but is a part of the primary crew oxygen system of an aircraft. As described above, the primary line 30 is typically maintained at an operating pressure, which is higher than an ambient pressure. As such, the pressure of the primary line 30 is typically higher than the pressure in the secondary line 20. A check valve 26 is provided in the secondary line 20 in order to prevent a flow of gas from the primary line 30 into the secondary line 20.

An actuator 14 is disposed in the secondary line 20 and is configured to allow a flow of gas from the secondary reservoir 12 through the secondary line 20. Upon actuation, the actuator 14 permits a flow of breathing gas from the secondary reservoir 12 to the secondary line 20. In some embodiments, such as the embodiment depicted in FIG. 1, the actuator 14 is disposed such that the secondary line 20 receives no gas from the secondary reservoir 12 until the actuator 14 is actuated. A pressure switch 32 is disposed in the primary line 30 and is configured to detect a pressure of the primary line 30. The pressure switch 32 actuates the actuator 14 when a loss of pressure is sensed in the primary line 30.

The pressure switch 32 may actuate the actuator 14 in any manner. For example, in the embodiment depicted in FIG. 2, the pressure switch 132 is in electrical communication with the actuator 114 and may provide an electrical signal to the actuator 114. Such electrical communication may be via wire 133, wireless, or other techniques that will be apparent in light of the present disclosure. In the example depicted in FIG. 1, a mechanical linkage 33 may connect the pressure switch and the actuator. Other actuation techniques are known and applicable in the present disclosure. In some embodiments, the pressure switch 32 is not a part of the system 10 and is instead a component present in the primary crew oxygen system. In other embodiments, the primary switch 32 is added to the primary crew oxygen system when such a primary system is retrofit with an embodiment of the presently disclosed secondary system. As such, the primary switch 32 may be considered to make up a part of the system 10.

A pressure reducer 18 may be disposed in the secondary line 20 and configured to reduce a pressure of the breathing gas from the supply pressure (a pressure at which the gas is stored in the secondary reservoir 12) to an operating pressure (a pressure at which the gas is presented to the crew mask(s)). The operating pressure may be, for example, 70 psig. In some embodiments, the pressure reducer 18 is configured to reduce a pressure of the breathing gas from the supply pressure to a line pressure (an intermediate pressure for use in the secondary line 20). As such, the system 10 may further comprise an inline regulator 24 for reducing the gas pressure from the line pressure to an operating pressure suitable for use by the masks.

A primary line check valve 34 is disposed in the primary line 30 to prevent a flow of gas from the secondary line 20 into a source side the primary line 30. Considering the point (the "connection point") at which the secondary line 20 is connected to the primary line 30, the source side of the primary line 30 is from the connection point back to the source of primary breathing gas—i.e., upstream. Accordingly, the mask side of the primary line 30 is from the connection point to the crew mask—i.e., downstream. As such, check valve 34 is intended to prevent the loss of breathing gas from the secondary system 10 due to the same failure which caused the loss of the primary breathing gas. One having skill in the art will note that it may be advantageous to minimize the length of the mask side so as to minimize the chance that a primary system failure will also cause a failure of the secondary system. It should be noted that providing gas to a breathing mask includes providing gas to a mask stowage box, providing gas to a plurality of breathing masks, or other configurations which will be apparent to one having skill in the art in light of the present disclosure.

In operation, as described above, the primary line 30 is pressurized to an operating pressure and, in the case of deployment of the crew mask(s), the primary crew oxygen system provides breathing gas to the mask(s). If there is a loss of pressure in the primary line 30, whether such loss of pressure occurs during the use of the mask(s) by the crew or before, the pressure switch 32 will actuate the actuator 14 of the secondary system 10 and breathing gas will flow from the secondary reservoir 12 through the secondary line 20 and through the mask side of the primary line 30 thereby supplying the mask(s) with breathing gas.

Embodiments of the present disclosure may include components which are combined, though such components need not necessarily be combined. For example, the pressure reducer 18 and the inline regulator 24 may be combined into a single component.

Figure 2:
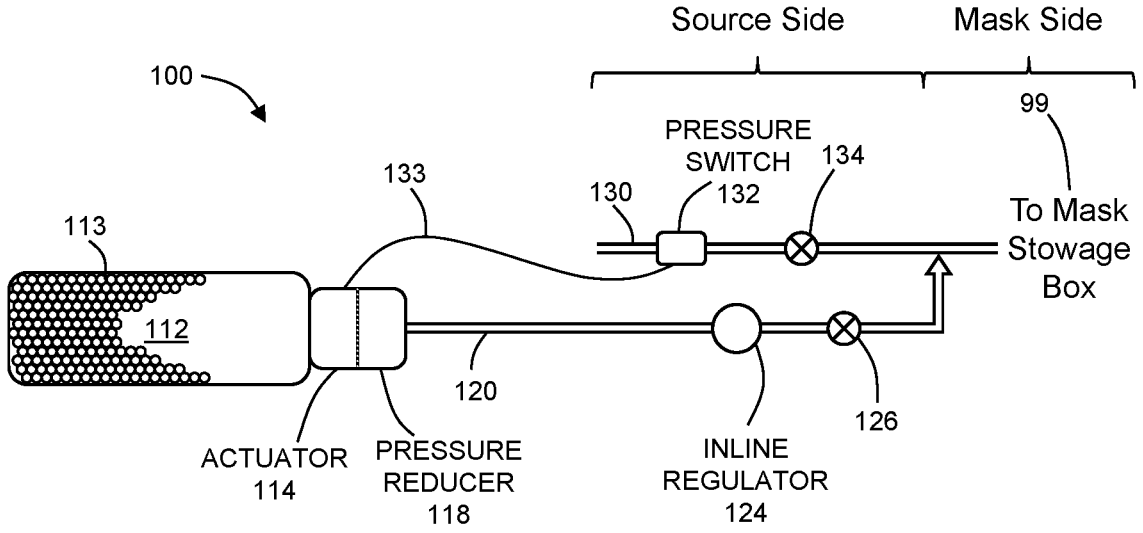
FIG. 2 is a diagram of a system according to another embodiment of the present disclosure in pneumatic communication with a primary line.

In some embodiments of the present disclosure such as that depicted in FIG. 2, the secondary reservoir is a pressure vessel 112. The pressure vessel 112 may contain a metal-organic framework (MOF) adsorbent 113. Such an MOF adsorbent 113 is configured to selectively adsorb and desorb breathing gas (e.g., oxygen) in the operational environment of an aircraft at altitude. The MOF adsorbent 113 is configured to store breathing gas more efficiently.

For example, when compared to a pressure vessel without an MOF, the MOF adsorbent 113 may enable more advantageous volume to pressure ratios. For example, a greater amount of gas may be stored at the same pressure and volume, or the same amount of gas may be stored at a lower pressure or volume, etc. In a particular example, the breathing gas is oxygen and the pressure vessel contains an MOF configured to adsorb oxygen.

Figure 3:
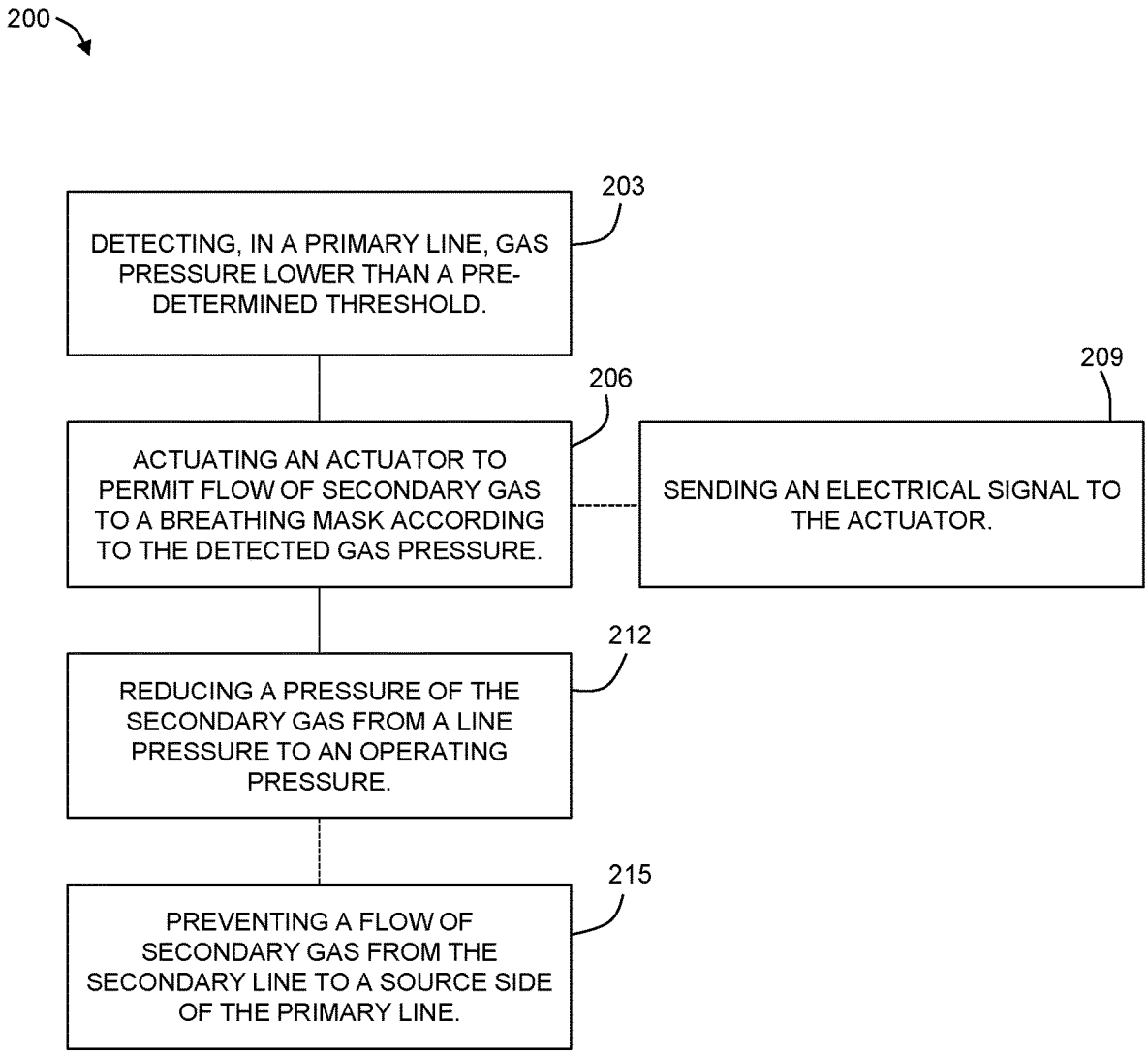
FIG. 3 is a chart showing a method according to another embodiment of the present disclosure.

Another aspect of the present disclosure is embodied as a method 200 for providing a secondary source of breathing gas to a mask. See FIG. 3. The method 200 includes detecting 203 a gas pressure lower than a pre-determined threshold in a primary line using a pressure switch. The primary line is in pneumatic communication with a breathing mask. An actuator is actuated 206 to permit a flow of secondary gas to the breathing mask by way of a secondary line and a mask side of the primary line. For example, as described above, if a low pressure is detected 203 by the pressure switch, the actuator is actuated 206. In an exemplary embodiment, the actuator may be actuated by an electrical signal sent 209 to the actuator. A pressure of the secondary gas is reduced 212 to an operating pressure. The gas may be prevented 215 from flowing from the secondary line to a source side of the primary line. For example, a valve, such as a check valve, may prevent gas from flowing to the source side of the primary line (i.e., directing gas flow to a mask side of the primary line).

Although the present disclosure has been described with respect to one or more particular embodiments, it will be understood that other embodiments of the present disclosure may be made without departing from the spirit and scope of the present disclosure. Hence, the present disclosure is deemed limited only by the appended claims and the reasonable interpretation thereof

What is claimed is:

1. A system for providing a secondary source of breathing gas to a mask, comprising:

a secondary reservoir having a breathing gas at a supply pressure;

a secondary line pneumatically connecting the secondary reservoir to a primary line;

an actuator configured to permit a flow of the breathing gas from the secondary reservoir through the secondary line upon actuation;

a pressure switch configured to detect a gas pressure in the primary line and to actuate the actuator upon a loss of pressure in the primary line;

a primary line check valve configured to prevent a flow of gas from the secondary line to a source side of the primary line; and a secondary line check valve configured to prevent a flow of gas from the primary line to the secondary line.

2. The system of claim 1, further comprising a pressure reducer disposed in the secondary line and configured to reduce a pressure of the breathing gas from the supply pressure to a line pressure.

3. The system of claim 2, further comprising an inline regulator for reducing the pressure in the secondary line from the line pressure to an operating pressure.

4. The system of claim 1, wherein the secondary reservoir comprises a pressure vessel.

5. The system of claim 4, wherein the pressure vessel contains a metal-organic framework (MOF) adsorbent.

6. The system of claim 1, wherein the pressure switch actuates the actuator by providing an electrical signal to the actuator.

7. The system of claim 1, wherein the pressure switch actuates the actuator by way of a mechanical linkage.

8. A method of providing a secondary source of breathing gas to a mask, comprising:

detecting gas pressure lower than a pre-determined threshold in a primary line using a pressure switch at a location upstream from a connection point at which a secondary line is connected to the primary line, the primary line being in pneumatic communication with a breathing mask;

actuating an actuator to permit a flow of secondary gas to the breathing mask by way of the secondary line; and reducing a pressure of the secondary gas to an operating pressure.

9. The method of claim 8, wherein actuating an actuator comprises sending an electrical signal to the actuator.

10. The method of claim 8, further comprising preventing a flow of gas from the secondary line to a source side of the primary line.

11. A system for providing a secondary source of breathing gas to a mask, comprising:

a secondary reservoir having a breathing gas at a supply pressure;

a secondary line pneumatically connecting the secondary reservoir to a primary line;

an actuator configured to permit a flow of the breathing gas from the secondary reservoir through the secondary line upon actuation;

a pressure switch configured to detect a gas pressure in the primary line at a location upstream from a connection point at which a secondary line is connected to the primary line and to actuate the actuator upon a loss of pressure in the primary line; and a primary line check valve configured to prevent a flow of gas from the secondary line to a source side of the primary line.

* * * * *